United States Patent [19]

O'Connor et al.

[11] Patent Number: 4,980,556

[45] Date of Patent: Dec. 25, 1990

[54] APPARATUS FOR GENERATING HIGH CURRENTS OF NEGATIVE IONS

[75] Inventors: John P. O'Connor, Wellesley, Mass.; Nicholas R. White, Horsham, England

[73] Assignee: Ionex/HEI Corporation, Newburyport, Mass.

[21] Appl. No.: 492,428

[22] Filed: Mar. 6, 1990

Related U.S. Application Data

[63] Continuation of Ser. No. 188,013, Apr. 29, 1988, abandoned.

[51] Int. Cl.[5] ..... H01J 27/02

[52] U.S. Cl. ..... 250/423 R; 250/425

[58] Field of Search ..... 250/423 R, 424, 425, 250/427; 313/359.1; 315/111.81

[56] References Cited

U.S. PATENT DOCUMENTS

| | | | |
|---|---|---|---|
| 3,374,384 | 3/1968 | Donnelly | 250/423 R |
| 3,395,302 | 7/1968 | Brown et al. | 250/423 R |
| 3,617,789 | 11/1971 | Middleton et al. | 250/423 R |
| 4,616,157 | 10/1986 | Naylor et al. | 250/423 R |
| 4,712,012 | 12/1987 | Naylor | 250/423 R |

*Primary Examiner*—Bruce C. Anderson

*Attorney, Agent, or Firm*—Henry C. Nields

[57] ABSTRACT

Disclosed is an apparatus for the generation of large currents of negative ions for use in tandem accelerators, suitable for employment in ion implantation on an industrial production scale. The apparatus includes a high current positive ion source which is coupled to a charge exchange canal where a fraction of the positive ions are transformed into negative ions.

16 Claims, 4 Drawing Sheets

APPARATUS FOR GENERATING HIGH CURRENTS OF NEGATIVE IONS

This application is a continuation of application Ser. No. 188,013, filed Apr. 29, 1988 abandoned.

BACKGROUND OF THE INVENTION

1. Field of the Invention

This invention relates to ion implantation utilizing tandem accelerators. More generally, this invention relates to any process which uses negative ions in procedures where ions are used to bombard a target.

2. Description of the Prior Art

In ion implantation or other processes where a beam of particles is incident upon a workpiece, there are a number of methods for generation of the particle beam with appropriate choice of species, energy, current and spatial extent. One method that has been used to obtain these projectiles is tandem electrostatic acceleration. In a tendam accelerator, negative ions, produced and mass analyzed near ground potential, are acclerated towards a positive high voltage terminal. In the terminal, the ions pass through a dilute gas (or a thin foil) where collisions occur between the electrons of the fast ions and those of the gas molecules (or the atoms in the foil). During these collisions, electrons are stripped from the ions changing their polarity from negative to positive. The positive ions are now repelled from the terminal and accelerated a second time back to ground potential. After acceleration, the ions are magnetically analyzed a second time to select the appropriate charge state and these ions now constitute the particle beam, the generation of which was desired. In the case of ion implantation processes these ions enter an end station where they are directed at semiconductor wafers.

For efficient use of these accelerators, an intense source of negative ions in necessary. Previously, negative ions have been generated in a number of ways. In one method, these ions have been produced in sputter sources similar to the prototypical source of R. Middleton disclosed in Nuclear Instruments and Methods, Volume 214, page 139 (1983). In this source, positive cesium ions are generated by surface ionization on a heated tungsten filament and accelerated towards a target which is negatively biased by five to ten kilovolts with respect to the filament. When the $Cs^+$ ions strike the target, a fraction of the target atoms are sputtered from the surface and a fraction of these will be negatively charged (the pressure of Cs lowers the work function of the surface and enhances the negative ion yield.) The negative ions are accelerated away from the target, focused, mass analyzed, and injected into a tandem accelerator. However, the yield of negative ions for species usable in semiconductor applications is low (less than one hundred microamperes) and limits the applicability of these sources to ion implantation.

A second method of producing negative ions is by charge exchange. Using gas targets, this technique was used to generate negative ions for the first tandem accelerators. Later, B. L. Donally and G. Thoeming indicated that large (greater than one percent) charge exchange fractions could be produced with metal vapors as the electron donor targets, as disclosed in the Physical Review at Volume 159 page 87 (1967). This speculation was shown to be accurate in the experimental work of Heinemeier et al. and of D'yachkov et al. (see, e.g. Nuclear Instruments and Methods, Volume 148, pages 65 and 425 (1978); Zh. Tech. Fiz. Volume 43, page 1726 (1973); and Prib. Tekh. Eksp. Volume 5, page 27 (1975)). However, these measurements yielded results of less than one hundred microamperes for the negative ion beam, which is insufficient for production-type ion implantation systems.

SUMMARY OF THE INVENTION

We have discovered that intense beams of negative ions may be produced by directing positive ions from a high current positive ion source to a charge exchange canal containing metal vapor, said canal being closely coupled to said ion source. The positive ions from the source are accelerated to 20–25 keV and immediately enter the charge exchange canal. The canal contains a sufficient charge of an alkali or alkaline earth metal to form a vapor of neutral metal atoms when the canal temperature is raised above room temperature. As the positive ions pass through the cell, the ions may gain or lose electrons as their electron clouds overlap with those of the neutral metal atoms. Upon leaving the canal, a certain fraction of the initially positive ions will have acquired a net negative charge. The canal temperature is selected at that value for which the fraction of negative ions of the desired species reaches a maximum value. The negative ions produced at his point may now be mass analyzed, accelerated, and directed at a workpiece.

In one embodiment of the invention, the charge exchange medium is sodium (Na) vapor. For this charge exchange system, the maximum fraction of negative ions of species used in semiconductor applications have been measured at 45 keV to be 8% for $^{11}B$,20% for $^{31}P$, and 15% for $^{75}As$. The increase in angular divergence of the negative ion beam during passage through the Na vapor has also been measured to be less than 2.5 mrad. This small increase is added in quadrature to the initial ion beam divergence.

In the most preferred embodiment of the invention, magnesium (Mg) is used as the electron donor target. Our measurements have demonstrated negative equilibrium charge state fractions of 8% for 45 keV $^{11}B$, 14% for 28 keV $^{31}P$, and 14% for 45 keV $^{75}As$. The measurements of the charge state fractions for $^{31}P$ and $^{75}As$ in Mg vapor and $^{75}$ As in Na vapor had not been previously performed.

BRIEF DESCRIPTION OF THE DRAWINGS

The invention may best be understood from the following detailed description thereof, having reference to the accompanying drawings, in which.

DESCRIPTION OF THE PREFERRED EMBODIMENT

Figure 1:
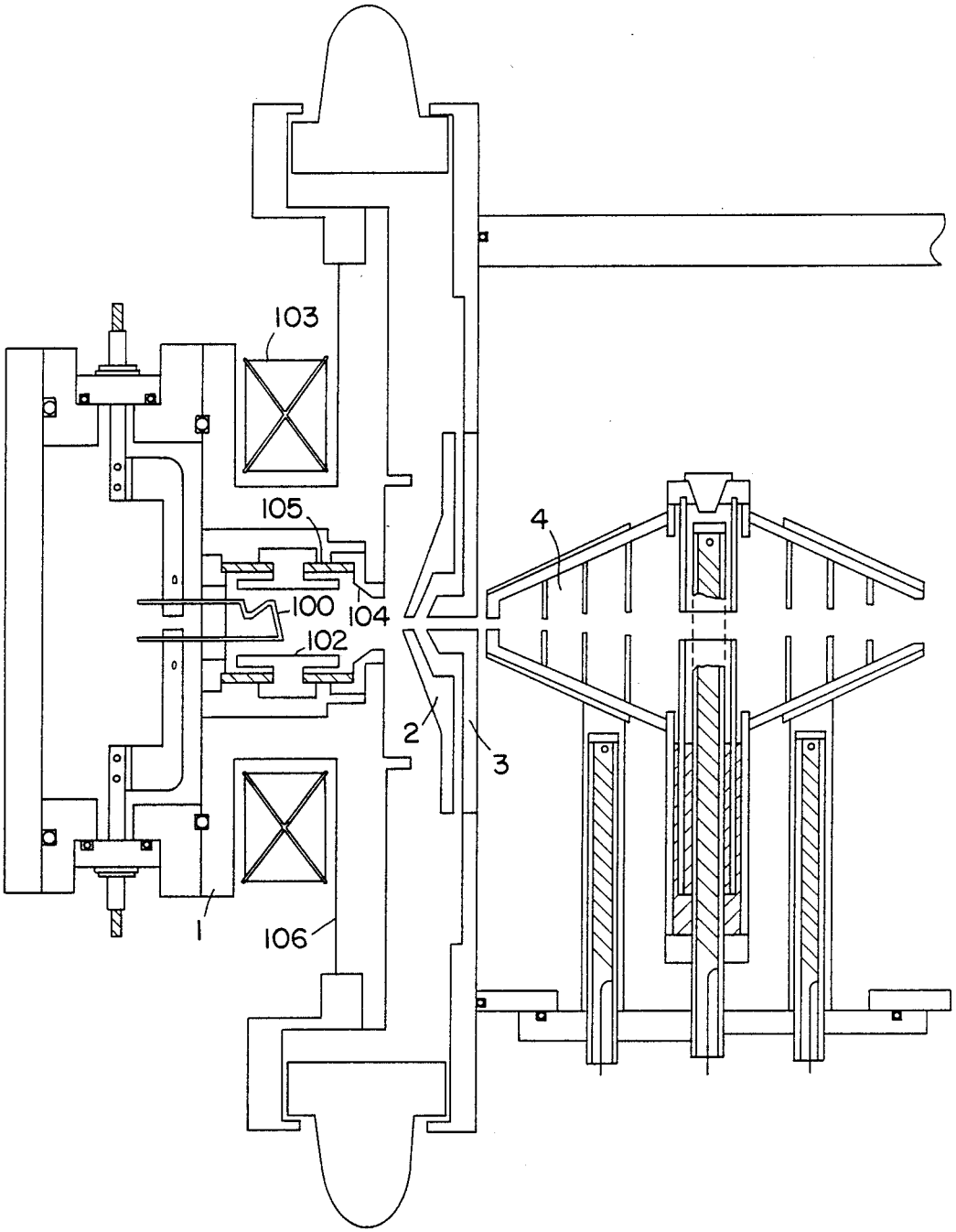
FIG. 1 is a diagrammatic cross sectional view of a preferred embodiment for use with sodium as the electron donor target in the charge exchange canal.
Figure 2:
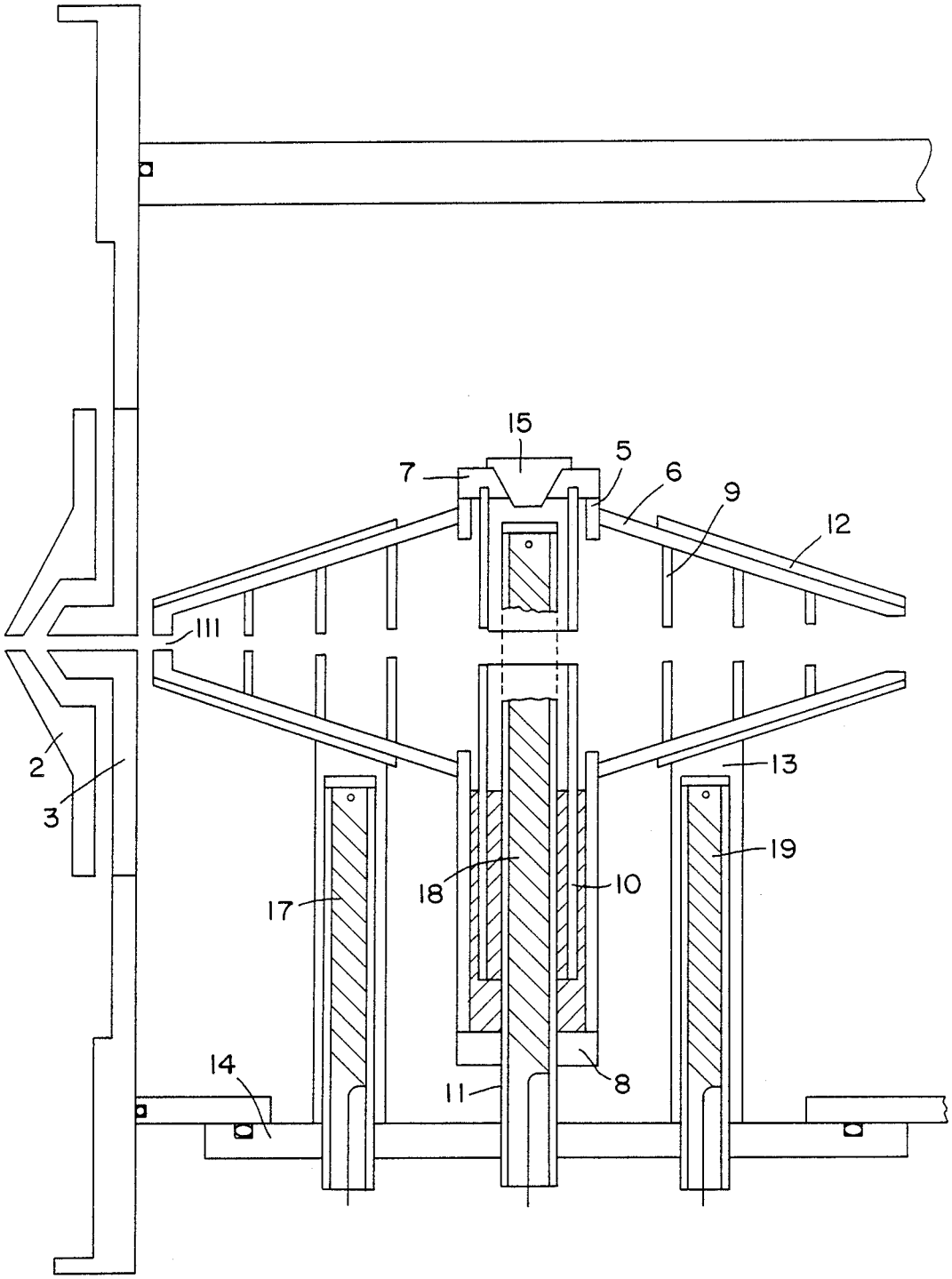
FIG. 2 is an enlarged view of a portion of FIG. 1.

Referring to the drawings, and first to FIGS. 1 and 2 thereof, therein is shown an injector which is one preferred embodiment of the invention. Said injector comprehends an ion source 1 with cylindrical geometry, electron suppression electrodes 2, extraction electrodes 3, and a charge exchange canal 4.

For a high current injector, the ion source 1 is a hot cathode PIG source (i.e. an ion source having so-called Penning ionization gauge geometry) with axial extraction through a cylindrical aperture and can produce several mA of $^{11}B^+$ and greater than 10 mA of $^{31}P^+$ and $^{75}As^+$. The basic principles of a PIG Source are well known, and are shown, for example, in U.S. Pat. No. 2,197,079 to Penning. When the ion beam is extracted from the ion source 1, it immediately enters the charge exchange canal 4. That is to say, the canal 4 is closely coupled to the ion source 1. The main body of the canal 4 is a welded unit of stainless steel to prevent corrosion from the Na metal. As shown in FIG. 2, the body consists of a cylindrical central region 5, two conical end caps 6, top caps 7 and bottom caps 8, a series of baffles 9, an inner cylinder 10, and a heater tube 11. In addition, two conical copper end caps 12 are brazed to the stainless conical end caps 6 to create isothermal regions of the canal. Further, two stainless steel support legs 13 are brazed to the copper end caps 12 and welded to the base flange 14. These parts are machined to allow insertion of a resistive cartridge heater and also to allow air flow for cooling of the support. A plug 15 is used to seal the top of the canal. A stainless tube 16 is welded tot he central cylinder and is used for air cooling. The charge exchange medium (Na) is loaded into the canal through the hole in the top and the plug is then inserted. Three cartridge heaters 17–19 are used to heat the canal to operating temperatures.

The control system of the Na charge exchange cell consists of three temperature controllers (20–22), three air solenoid valves (23–25), and the three cartridge heaters (17–19). The controllers are used to determine the operating temperature of the heaters and hence the canal. The cartridge heaters have built in thermocuoples which are placed between the heater element and the canal. As a result, there is no overshooting of the desired setpoint temperature.

In normal operation, the center of the canal is heated to produce a Na vapor thickness of $2.5\times10^{15}$ atoms/cm$^2$ in the path of the ion beam. This requires a Na pressure of $1.5\times10^{-2}$ Torr. Since the Na vapor pressure is determined by the temperature of the canal according to the following relation:

$$^{10}\log P = 10.86 - 5619/T + 3.45\times10^{-6}{}^{*}T - 1.04^{1\cdot}$$
$$^{c}\log T.$$

where P is the pressure in Torr and T is the absolute temperature, the center of the canal is raised to 300° C. The relationship between vapor pressure and temperature is shown, for example, in A. N. Nesmeyanov's article in Vapour Pressures of the Chemical Elements,k ed., R. Gary (Elsevier Publ. Co., Amsterdam, 1963).

It is noted that the melting point of sodium is 97° C. so the metal becomes molten before significant vaporization occurs. As a result, the canal is designed to recirculate the Na which migrates from the center of the canal. The baffles 9 and conical end caps 6 are maintained at a temperature of 150° C. Any Na vapor which strikes the baffles 9 or the inside of the conical end caps 6 liquifies and flows back to the central cylinder 5. This provides the maximum use of the Na which is in the canal. Also, since the vapor pressure of Na at room temperature is less than $10^{-10}$ Torr, any Na atoms which migrate out of the canal will stick to the first surface that they encounter thereby minimizing the migration of Na along the walls of the accelerator tubes.

The ion source of FIG. 1 includes a filament 100, which is heated by a suitable heater voltage source (not shown) so as to emit electrons, and a cylindrical anode 102 surrounding the filament 100. A voltage source (not shown) maintains the filament 100 at a negative potential of 2000 volts with respect to the anode 102. As a result, electons emitted by the filament 100 are accelerated towards the anode 102. A coil 103 energized by a current source (not shown) generates a magnetic field in the region traversed by the electrons. The magnetic field is in the direction of the axis of cylindrical symmetry of the ion source 1, and therefore in moving towards the anode 102 the path of the electrons is bent so that the electrons move in long spiral paths towards the anode 102.

The gas to be ionized is admitted into the ion source through a valve (not shown) from a gas source (not shown). Because of the long path length of the electrons, each electron ionizes several gas molecules before reaching the anode 102. In this way a copious supply of positive ions of the desired type is created in the region between the filament 100 and the anode 102.

The anode 102 is supported upon an apertured focus electrode 104 by an insulating ring 105, and the focus electrode in turn is mounted on a cylindrical member 106 which forms a major part of the wall enclosing the ion source 1. Poisitive ions are removed from the ion source 1 through the aperture in the apertured focus electrode 104 by means of an extraction electrode 3 which is maintained at a voltage of −20 to −45 kilovolts with respect to the focus electrode 104 by means of an extraction voltage source (not shown). Secondary electrons emitted from the extraction electrode 3 are suppressed by the suppressor electrode 2 to which a suitable electron suppression voltage with respect to the focus electrode 104 is applied by means of a suppression voltage source (not shown).

The focus electrode 104, the suppressor electrode 2 and the extraction electrode 3 form an electrostatic lens system. The dimensions of these electrodes, and the voltages applied thereto, are so chosen that the positive ions emerge from the ion source 1 as a slightly convergent beam having a circular cross section of a diameter of the order of $10^{-2}$ meters.

The charge exchange canal 4 is positioned as close to the ion source 1 as electrical and mechanical considerations will permit, and the position of the canal 4 is so related to the convergence of the beam that the waist of the beam is at the entrance aperture 111 of the canal 4. In this way the canal 4 is geometrically and electtrically coupled to the ion source 1.

This proper dimensioning of the electrostatic lens system may be accomplished by computer programs well known in the art. The inventive feature claimed herein relates tot he interaction of the slightly convergent ion beam and the canal 4 which is thus coupled to the ion source 1.

Figure 3:
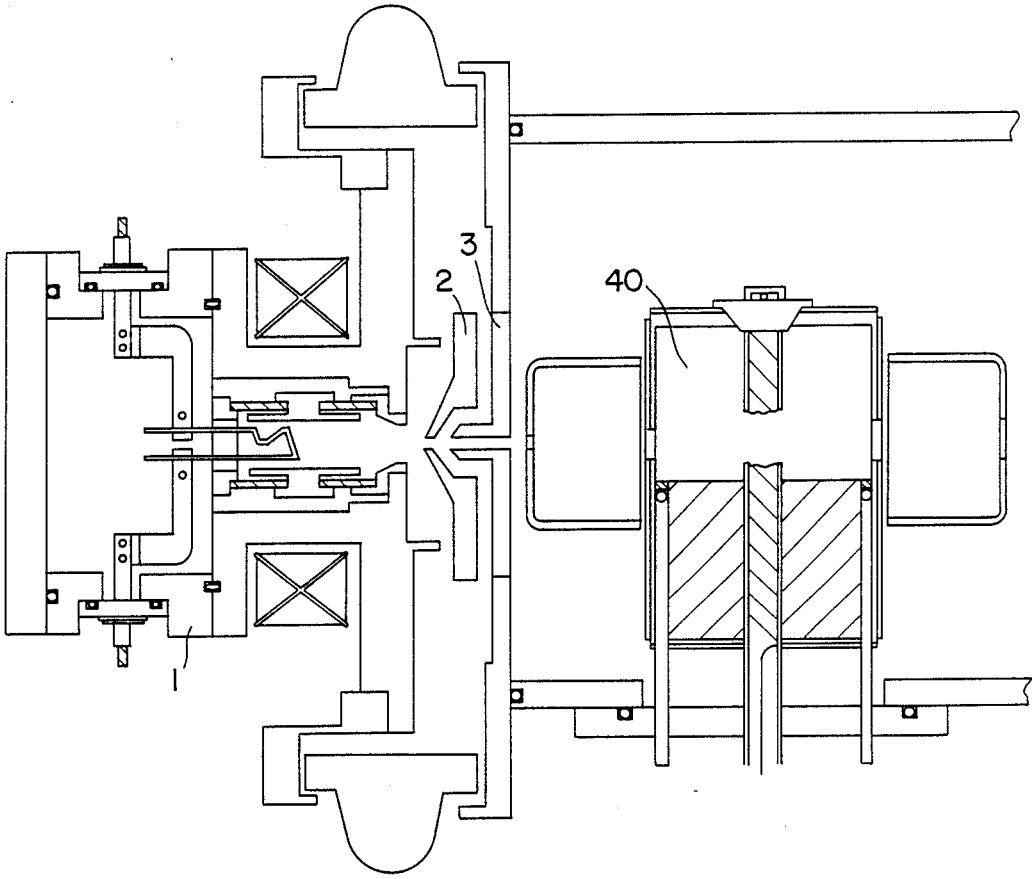
FIG. 3 is a diagrammatic cross sectional view of the most preferred embodiment for use with magnesium as the electron donor target.
Figure 4:
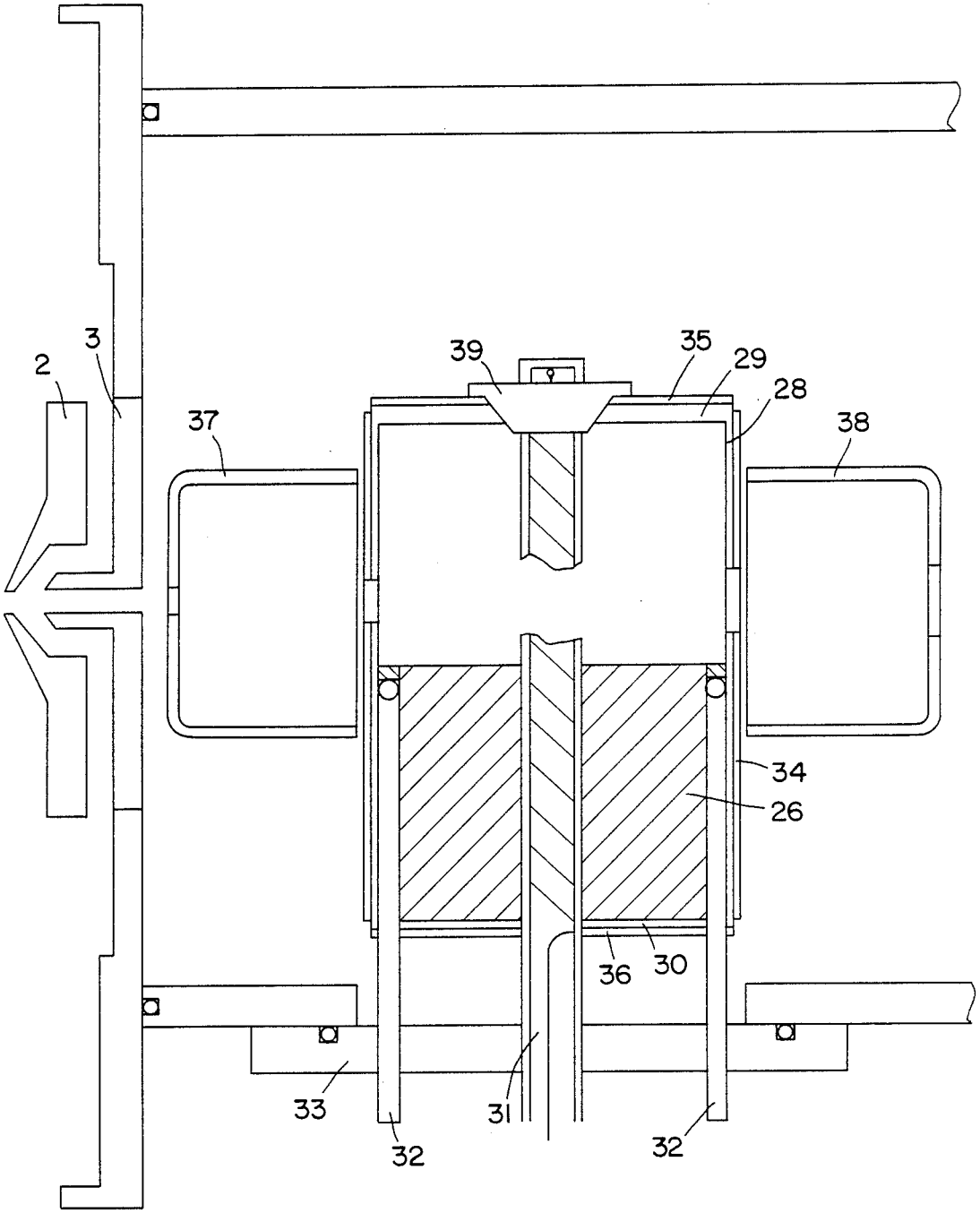
FIG. 4 is an enlarged view of a portion of FIG. 3.

FIG. 3 shows a diagrammatic view of the most prefered embodiment. A high current positive ion source of the type shown in FIG. 1 is shown in FIG. 3 at 1. The ion source 1 is cylindrically symmetric and has a suppression electrode 2 and an extraction electrode 3. A charge exchange system is shown at 40. In the embodiment of FIGS. 3 and 4, Mg is used as the charge exchange medium 26. An oven assembly 27 consists of a stainless steel cylinder 28, a top plate 29 and a bottom plate 30, a heater 31 and air-cooling tubes 32 an a vacuum flange 33. The assembly also includes a copper (Cu) cylinder 34 and Cu end caps 35–36. These components are furnace brazed to form a single unit. Brazing is used to have optimum heat conduction and the Cu pieces maintin the oven as an isothermal region. A plug 39 (either graphite or stainless steel) is used to seal the oven. Since the Mg sublimes, there is not need for a recirculating desing as with the Na canal. Instead, cooled aluminum collector cups 37,38 are used to capture the Mg which drifts out of the oven assembly.

For this assembly, only one cartridge heater and air cooling system is required. The power to the resistive heater and flow of air to the cooling system is controlled by a temperature controller which senses the temperature of a thermocouple mounted in the heater. This thermocouple is placed between the heater element and the oven to eliminate the possibility of overshooting the desired temperature. during operation, the oven temperature is maintained to plus or minus 2° C.

In normal operation, the oven asembly is heated to generate a pressure of $1.0\times10^{-2}$ Torr of Mg vapor in the oven assembly. This corresponds to a vapor thickness of $3\times10^{15}$ Mg atoms/cm$^2$ in the path of the ion beam. Our measurements have demonstrated maximum equilibrium charge state fractions with small increases in beam angular divergence at these Mg pressures. The vapor pressure-canal temperature relationship for Mg is:

$$^{10}\log P=9.7124-7753.5/T-2.453\times10^{-4}T-0.2292\ ^{10}\log T,$$

where P is the pressure in Torr and T is the absolute temperature.

The use of Mg as the charge exchange medium has several advantages. First, no negative ions of Mg exist so that they can not be accelerated down the column of the tnadem accelerator. Second, the vapor pressure of Mg at room temperature is less than $10^{-7}$ Torr which implies that any Mg which leaves the oven will be captured on the first surface encountered. This fact is used with the cooled aluminum collector cups 37,38 which capture the majority (more than 99%) of the Mg which migrates out of the oven assembly. These cups are disposed of every few months when they are filled with Mg. Finally, since the melting point of Mg is 520° C., there is no flow of Mg which escapes from the oven along the walls of the accelerator tube.

We claim:

1. Apparatus for generating high currents of negative ions for injection into tandem accelerators such as those used in ion implantation, comprising a high current positive ion source having Penning ionization gauge geometry with axial extraction through a cylindrical aperture and including an electrostatic lens system formed by a focus electrode 104, a suppressor electrode 2 and an extraction electrode 3, the dimensions of these electrodes, and the voltages applied thereto, being so chosen that the positive ions emerge from said ion source as a slightly convergent positive ion beam with a waist, a metal vapor charge exchange canal having an entrance aperature at the waist of the positive ion beam and therefore closely coupled to said positive ion source, and means for directing a high current of positive ions from said source to said canal.

2. The apparatus of claim 1 wherein Na is the charge exchange medium.

3. The apparatus of claim 2 wherein said ion source produces $^{75}$As+ions.

4. The apparatus of claim 2 wherin the canal is designed to recirculate the Na which migrates from the central region of the canal.

5. The apparatus of claim 2 wherein there are included three independent temperature controllers, resistived cartridge heaters and air cooling, in conjunction therewith for accurately determining the temperatures of the regions of the canal.

6. The apparatus of claim 5, including heaters with built-in thermocouples that are situated between the heating element and the part to be heated so as to ensure no overshoot of the desired temperature.

7. The apparatus of claim 1 wherein Mg is the charge exchange medium.

8. The apparatus of claim 7 wherein said ion source produces $^{31}$P+ ions.

9. The apparatus of claim 7 wherein said ion source produces $^{75}$AS+ions.

10. The apparatus of claim 7 wherein there is includes an isothermal oven assembly obtained by brazing of a Cu sheath over a stainless cylinder.

11. The apparatus of claim 7 wherein there are included a temperature controller and a resistive cartridge heater and air cooling in conjunction therewith, for maintaining the temperature of the oven assembly.

12. The apparatus of claim 11, including a heater with a built-in thermocouple placed between the heating element and the oven to prevent overshoot of the desired temperature.

13. The apparatus of claim 7 wherein there are included cooled Aluminum cups adapted to capture the Mg which drifts out of the oven.

14. The apparatus of claim 13, wherein said cups are designed for disposal when filed with Mg every few months.

15. The apparatus of claim 1, including means for directing positive ions from said positive ion source into said canal as a slightly convergent cylindrical beam having its waist at the entrance to said canal.

16. Apparatus for generating an intense beam of negative ions, comprising in combination a high current positive ion source having Penning ionization gauge geometry with axial extraction through a cylindrical aperture and including an electrostatic lens system formed by a focus electrode 104, a suppressor electrode 2 and an extraction electrode 3, the dimensions of these electrodes, and the voltages applied thereto, being so chosen that the positive ions emerge from said ion source as a slightly convergent positive ion beam with a waist, a charge exchange canal having an entrance aperture at the waist of the positive ion beam and therefore closely coupled to said ion source, means for accelerating positive ions from said ion source to an energy of the order of $10^4$ electron volts and oimmediately directing said accelerated positive ions into said canal, a charge of metal the vapor whereof is in communication with said canal, and means for raising the temperature of said charge sufficiently to produce metal vapor in said canal.

* * * * *